US007811031B2

(12) United States Patent
Öberg

(10) Patent No.: US 7,811,031 B2
(45) Date of Patent: Oct. 12, 2010

(54) DEVICE AND METHOD FOR INSTALLING A ROCK BOLT AND A ROCK BOLT INSTALLATION RIG

(75) Inventor: Fredrik Öberg, Örebro (SE)

(73) Assignee: Atlas Copco Rock Drills AB, Orebro (SE)

( * ) Notice: Subject to any disclaimer, the term of this patent is extended or adjusted under 35 U.S.C. 154(b) by 401 days.

(21) Appl. No.: 11/886,552

(22) PCT Filed: Mar. 24, 2006

(86) PCT No.: PCT/SE2006/000371

§ 371 (c)(1),
(2), (4) Date: Sep. 17, 2007

(87) PCT Pub. No.: WO2006/118504

PCT Pub. Date: Nov. 9, 2006

(65) Prior Publication Data

US 2009/0016823 A1 Jan. 15, 2009

(30) Foreign Application Priority Data

May 3, 2005 (SE) ..... 0501013

(51) Int. Cl.
*E21D 20/00* (2006.01)

(52) U.S. Cl. ..... 405/259.3

(58) Field of Classification Search ..... 405/258.1, 405/259.1, 259.3

See application file for complete search history.

(56) References Cited

U.S. PATENT DOCUMENTS

| | | | | | |
|---|---|---|---|---|---|
| 3,832,860 | A * | 9/1974 | Jahnke | ..... | 405/259.1 |
| 3,832,861 | A * | 9/1974 | Jahnke et al. | ..... | 52/127.5 |
| 4,201,270 | A * | 5/1980 | Ribich et al. | ..... | 173/193 |
| 4,423,986 | A | 1/1984 | Skogberg | | |
| 4,626,139 | A * | 12/1986 | Blackwell | ..... | 405/259.1 |
| 4,655,644 | A * | 4/1987 | Lane et al. | ..... | 405/259.5 |
| 4,765,778 | A * | 8/1988 | Valentine | ..... | 405/259.5 |
| 6,102,118 | A * | 8/2000 | Moore | ..... | 166/241.7 |
| 6,585,456 | B2 * | 7/2003 | Forse | ..... | 405/259.1 |
| 6,698,529 | B2 * | 3/2004 | Coombs et al. | ..... | 173/4 |

FOREIGN PATENT DOCUMENTS

| | | |
|---|---|---|
| DE | 4024869 | 2/1991 |
| DE | 3933813 | 4/1991 |

* cited by examiner

*Primary Examiner*—Tara Mayo-Pinnock
(74) *Attorney, Agent, or Firm*—Mark P. Stone

(57) ABSTRACT

A device (5) for installing a pressure fluid expandable rock bolt (4) of the kind having a tubular expansion portion and a fitting portion, said device at a distal portion having chuck means for gripping the fitting portion and for establishing a sealed connection between a fluid source and the inlet, said device extending essentially in an axial direction. The device includes at a proximal portion a holder portion (11) that is adapted to be fitted to a drill string engagement element (27) of a rock drilling machine. The invention also concerns a method and a rig.

20 Claims, 2 Drawing Sheets

DEVICE AND METHOD FOR INSTALLING A ROCK BOLT AND A ROCK BOLT INSTALLATION RIG

FIELD OF THE INVENTION

This invention concerns a device for installing a rock bolt according to the preamble of claim 1. It also concerns a method for installing a rock bolt according to the preamble of claim 11. The invention also concerns a rock bolt installation rig.

BACKGROUND OF THE INVENTION

Installation of rock bolts in order to stabilize unstable rock face in tunnels and galleries is potentially unsafe because of the risk for collapsing structures. For that reason it is a desire that the operator always stays under secured rock while installing the rock bolts. That is that it is possible for him to stand under an already stabilized rock face while installing further rock face stabilizing bolts.

According to the background art, installation is made purely manually or in a mechanized or semi-mechanized way with the help of rock bolt installation appliances. There are rigs available for fully mechanized installation of rock bolts. Such equipment is not always economically justified, in particular in smaller cites.

AIM AND MOST IMPORTANT FEATURES OF THE INVENTION

It is an aim of this invention to provide a solution to the problems of the prior art and in particular to provide an economic, yet safe, solution for rock bolt installation.

This aim is obtained in a device according to the above through the features of the characterizing portion of claim 1.

The corresponding aim is obtained in a method according to the above through the features of the characterizing portion of claim 11.

By the device including a holder portion that is shaped so as to be fitted to a drill string engagement element of a rock drilling machine, it is possible to use a rock drill rig carrying a rock drilling machine so as to use the ordinary rock drilling machine feed means for placing the rock bolt into the hole. This is a great advantage since a safe installation method will be provided. The operator is always positioned under secured rock. It is possible to use great force to push or even hammer the bolt into the hole with great force using the rock drilling machine with its feed means.

In particular, in rock with lots of crevices and cracks there might be rock pieces obstructing the hole. Corresponding problems are overcome according to the invention.

In a preferred embodiment the holder portion is shaped so as to fit on a shank adaptor. In that case it could be pipe-shaped having an inner diameter corresponding to the outer diameter of the shank adapter.

By having flexing means between the chuck means and the holding portion it is possible to allow a slight misalignment of the rock bolt with respect to the hole. In particular it is preferred that the flexing means includes elastic means, that strive to axially align the chuck means with the holding portion. This provides for better control of the rock bolt with the aid of the rock drilling machine positioning means. By having first and second flexing portions, freer movement of the chuck means with respect to the holding portion, is possible. By having an elastic pack between two metal members that are pressed towards each other it is possible to obtain a desired pretension of the elastic means.

By having fluid feed conduits for grip fluid and expansion fluid positioned in axially extending cavities inside a circumference of the device, the radial dimensions may be minimized and ware of the conduits eliminated or at least reduced. In particular it is preferred that the cavities extend as axial grooves passing each metal member as well as each elastic pack.

According to a very important aspect of the invention the radial dimensions of the device including fluid conduits is less than a free inner dimension of a drill steel support with fixed support bushing, at least of a portion of the device as seen from its distal end portion to a position corresponding to a distance between the drilling machine and the closest drill steel support when the machine is in an advanced position. This means over a part of the device that can pass inside such a drill steel support when the rock drilling machine with fitted installation device and gripped expandable rock bolt has been positioned in its most forward position. This way the device is possible to use with common drill steel supports that need not be removed or be of an openable type. The device is simply possible to use in a common rock drill rig without any modifications of these parts. It is only necessary to provide a rotation obstructing means on the device co-operating with an anchoring means at the rock drilling machine.

Corresponding advantages are obtained according to the method claims.

BRIEF DESCRIPTION OF DRAWINGS

The invention will now be described in more detail with reference to the annexed drawings, wherein:

FIG. 1 diagrammatically shows a rock drill rig for use with a device according to the invention.

DESCRIPTION OF EMBODIMENT

Figure 6:
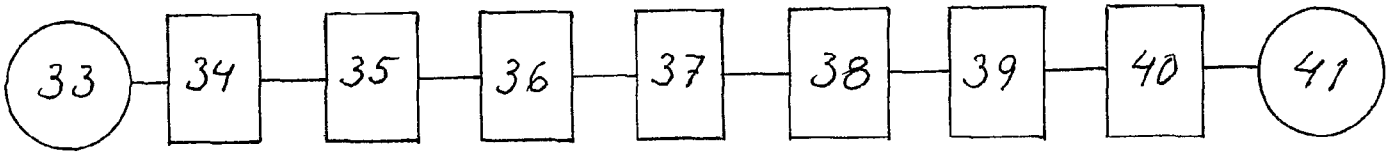
FIG. 6 shows a diagram over a method according to the invention.
Figure 7:
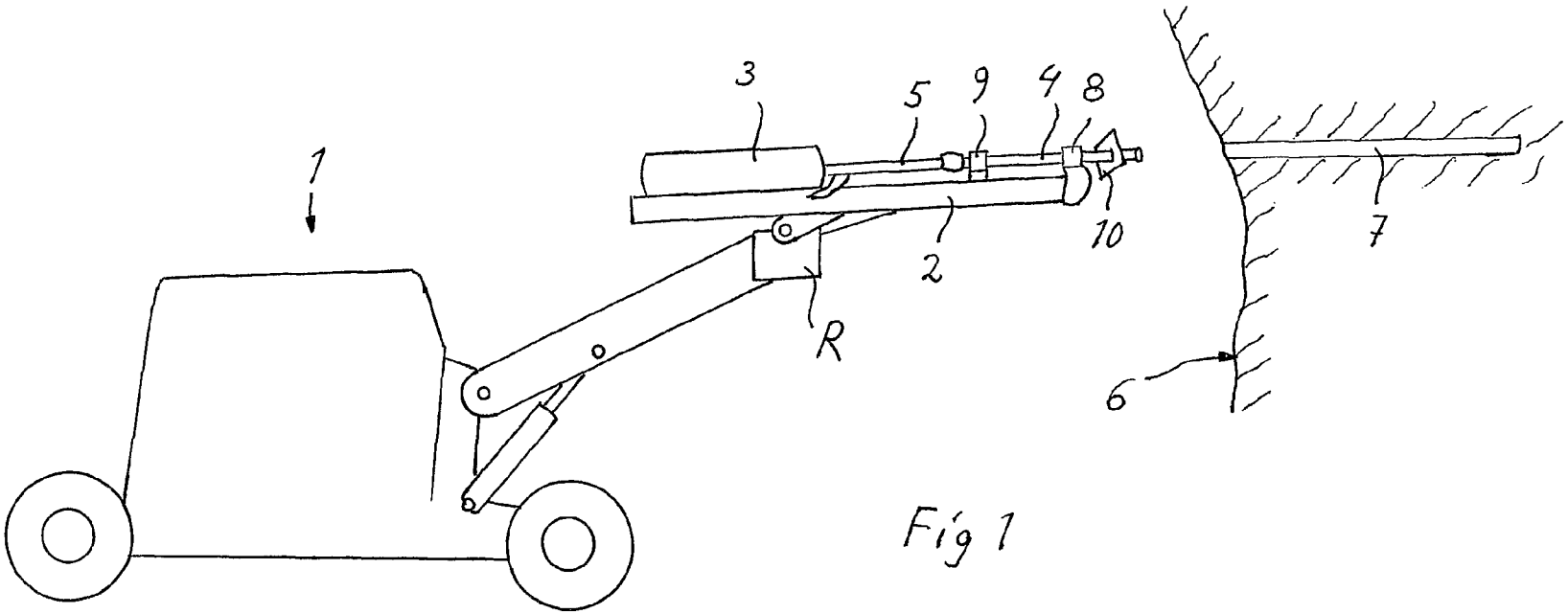

In FIG. 1 a rock drill 1 is diagrammatically shown carrying a feed beam 2 for a drilling machine 3 over a lift arm and a rotator R. The drilling machine 3 is equipped with a device 5 for installing a pressure fluid expandable rock bolt 4 and in particular it is fitted to a drill string engagement element of the rock drilling machine 3.

The feed beam 2 carries a fixed drill steel support 8 at its outer end region and, as usual, a movable drill steel support 9 between the drilling machine 3 and the support 8. Both drill steel supports are having guide bushings that are non-openable. 10 indicates a face plate which is positioned at the outer end of the rock bolt 4 and is as usual intended to support a region of the rock face 6 when the rock bolt 4 is properly installed into a bolt hole 7.

Figure 2:
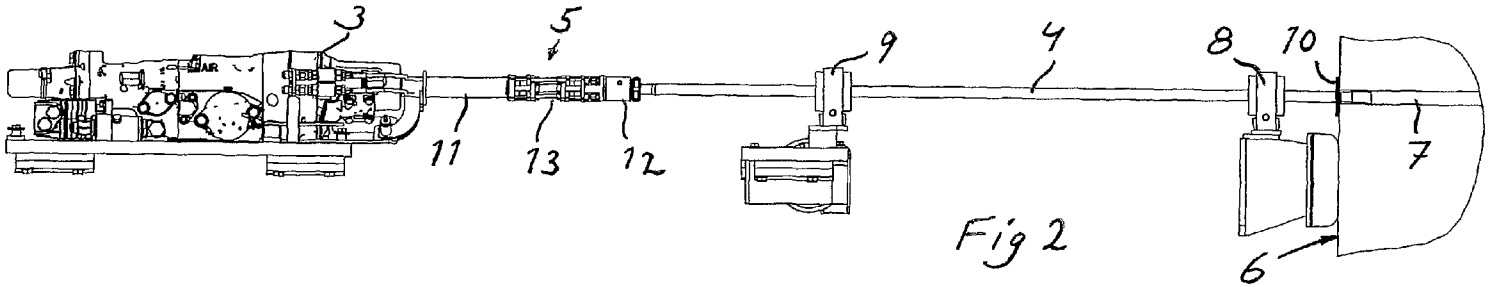
FIG. 2 shows a device according to the invention connected to a rock drilling machine.

In FIG. 2 the device for installing the bolt 5 is shown in more detail with a chuck means 12 at its distal region and a holder portion 11 in its proximal portion. Intermediate there is a flexing means 13 for allowing a limited movement, angular as well as parallel between the chuck means 12 and the holder portion 11.

Figure 3:
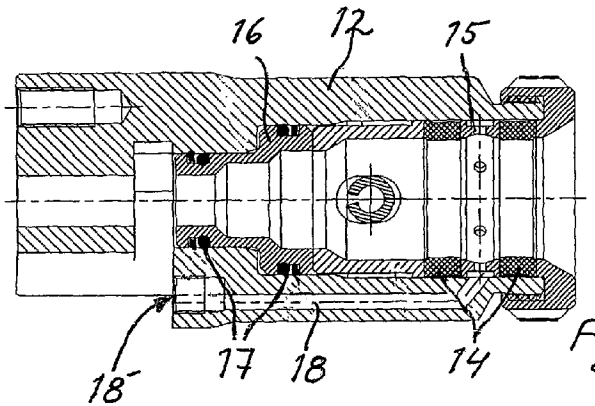
FIG. 3 shows a chuck means of a device according to the invention in an axial section.

The chuck means 12 shown in FIG. 3 includes a housing that comprises a cylinder means enclosing a piston 16 which is sealed against the housing through seals 17 and which can be actuated such that upon pressurizing, the piston 16 moves to the right as seen in FIG. 3, whereupon two sealing and gripping rings 14 are axially compressed so that they expand radially in order to grip against a fitting portion, with radially directed fluid inlet, of a (not shown) rock bolt.

Between the sealing and gripping means 14 there is arranged an apertured/perforated distance ring 15 which is positioned such that its position will match the position of an inlet on the fitting portion of the rock bolt. A bolt expansion channel is indicated at 18, and after actuating the sealing and gripping rings, there will be established a sealed channel between an expansion fluid source (not shown) over the channel 18, the apertures in the distance ring 15 and a tubular expansion portion of the rock bolt.

After a properly carried out expansion, the chuck means is released from the fitting portion of the rock bolt by releasing pressure from the chamber formed between the housing cylinder and the piston 16. The sealing and gripping rings 14 will then flex back to the position shown in FIG. 3, whereupon the chuck means 12 may be removed from the rock bolt.

Figure 4:
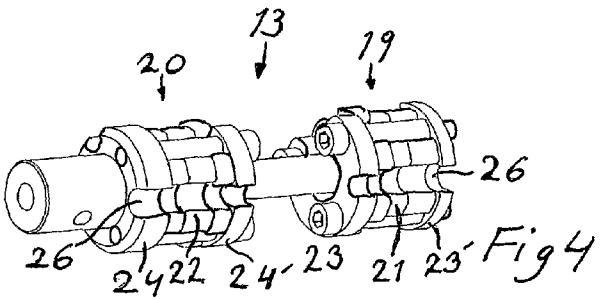
FIG. 4 shows a flexing means of the device according to the invention in a perspective view.

FIG. 4 shows the flexing means 13 in more detail to the extent that it includes a first flexing portion 19 and a second flexing portion 20 having a first elastic pack 21 and a second elastic pack 22, respectively. These elastic packs are comprised of rubber or rubber-like discs that are positioned so as to allow a certain limited movement between metal members 23, 23' and 24, 24', respectively, on each part of each elastic pack 21 and 22. The metal members 23, 23' and 24, 24' are interconnected over axially extending fasteners 25 that are distributed over the circumference of the flexing means in such a way that each elastic pack is pre-stressed to a certain determined level.

26 indicates axially extending grooves passing each elastic pack as well as each metal member for allowing passage of hoses/conduits for chuck actuating and bolt expansion fluid inside the circumference of the flexing means.

In this connection it is referred back to FIG. 3, wherein the channel 18 is shown having an axially directed mouth 18'. The corresponding arrangement is provided for chuck actuating fluid conduit (not shown). These measures contribute to having the overall radial dimensions of the device to a minimum, allowing passage of the device through the drill steel supports.

Figure 5:
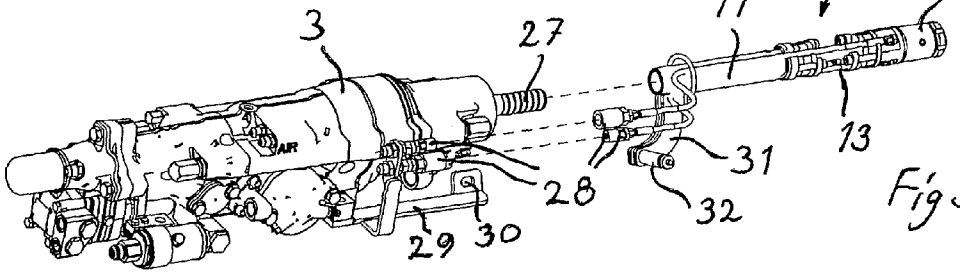
FIG. 5 shows a device according to the invention disassembled from a drilling machine.

In FIG. 5 the device 5 is shown disassembled from the drilling machine 3 and in particular from the shank adaptor 27. It should be noted that the holder portion 11 is shown pipe shaped/tubular so as to fit properly onto the shank adaptor 27 when it is moved axially against the drilling machine 3. Furthermore, on the drilling machine 3 there is arranged an attachment 29 which is to be fixed on the drilling machine. On the holder portion there is extending a double fastening arm 31 which is able to receive a part of the attachment 29 between two separate elements of the fastening arm 31 for preventing rotational movement of the device 5. 28 are chuck actuator and bolt expansion fluid copplings.

32 indicates a mechanism including a locking pin (not shown) which is intended to engage into an oblong hole 30 of the attachment 29. Through the oblong shape of the hole 30, a certain-axial movement of the device 5 is allowed with respect to the drilling machine 3, which makes it possible to use the impact mechanism of the drilling machine 3 to assist in positioning a rock bolt into a pre-drilled hole in order to overcome possible obstructions in said hole.

In FIG. 6 the method is briefly illustrated as a sequence starting with start position 33.

In position 34 a holder portion of a device according to the invention is fitted to a drilling machine. This is accomplished in a rig according to FIG. 1 by rotating the feed beam so that the front of the drilling machine is available for the operator from the operator's platform.

Position 35 concerns inserting a rock bolt into a chuck means and positioning a face plate on the bolt.

Position 36 concerns actuating the chuck means so as to grip and seal against a fitting portion of the rock bolt.

Position 37 concerns positioning rock bolt at bolt hole.

Position 38 concerns driving the rock bolt into the hole using the drilling machine feed.

In position 39 the rock bolt is inflated through pressurizing.

In position 40 the chuck means is loosened and withdrawn from the rock bolt.

Position 41 is the end of the sequence.

Continue from position 35.

The invention can be modified within the scope of the annexed claims. In particular the chuck means can be shaped otherwise so as to fit to otherwise shaped fitting portions of an expandable rock bolt. The flexing means preferably includes elastic means as is shown and described above, but it is also within the scope of the invention to have an arrangement allowing a certain limited movement between the two portions. In this connection it could be mentioned that it is preferred that upon installing a rock bolt and actuating feed, after having flexed a determined length upon resistance, there is metallic contact between the parts of the flexing means so that a greater amount of feed power can be transmitted to the rock bolt in order to overcome i.e. obstructions in the bore hole.

It is also within the scope of the invention that the drill rig is flexible in itself so that certain alignment demands can be met by fine-tuning the control of the feed beam of the drill rig.

The holder portion can also be arranged otherwise, even if the shown and described solution is preferred. It is also possible to envisage a solution where the same fluid conduit is used for actuating the chuck means as well as for expanding the rock bolt, for example by having valve means releasing at a certain pressure level increase.

The invention claimed is:

1. A device (5) for installing a pressure fluid expandable rock bolt (4) of the kind having a tubular expansion and a fitting portion, said device at a distal portion having chuck means (12) including gripping means and sealing means arranged to grip said fitting portion and to establish a sealed connection between a fluid source and a fluid inlet of said rock bolt, said device extending essentially in an axial direction, wherein the device at a proximal portion includes a holder portion (11) that is adapted to be fitted to a drill string engagement element (27) of a rock drilling machine (3), and wherein the device includes flexing means (13) positioned axially between the chuck means and the holder portion for allowing a limited pivoting movement between the chuck means and the holder portion.

2. The device according to claim 1, wherein the holder portion (11) is adapted to fit on a shank adapter (27).

3. The device according to claim 1, wherein the flexing means includes elastic means (21, 22) for achieving axial alignment between the chuck means and the holder portion.

4. The device according to claim 3, wherein the flexing means includes a first and a second flexing portion (19, 20) for allowing relative parallel displacement between the chuck means and the holder portion.

5. The device according to claim 1, wherein the flexing means includes a first and a second flexing portion (19, 20) for allowing relative parallel displacement between the chuck means and the holder portion.

6. The device according to claim 5, wherein each said flexing portion includes an elastic pack (21, 22) axially between two metal members, which are connected over axially extending fasteners pressing the metal members towards each other.

7. The device according to claim 6, wherein said fasteners (25) are arranged to allow the metal members to move towards each other against the elastic resistance of the elastic pack.

8. The device according to claim 6, wherein fluid feed conduits for chuck grip fluid and bolt expansion fluid are positioned in axially extending cavities radially inside a circumference of the device.

9. The device according to claim 8, wherein said cavities extend as radial grooves (26) past each metal member and elastic pack.

10. The device according to claim 1, wherein the radial dimensions including fluid conduits of the device is less than free inner dimensions of a drill steel support with fixed support sleeve.

11. A rock bolt installation and rock drill rig including the device according to claim 1.

12. A method for installing a pressure fluid expandable rock bolt (4) of the kind having a tubular expansion portion and a fitting portion, wherein the fitting portion is gripped by a device including chuck means and a sealed connection between a fluid source and a fluid inlet of said rock bolt is established, whereafter the rock bolt is expanded and subsequently released, wherein a holder portion (11) of the device is fitted to a drill string engagement element of a rock drilling machine (3) before coming into gripping and sealing engagement with the rock bolt, wherein the rock bolt (4) is positioned at the opening of a predrilled bore hole in a rock face, wherein the rock bolt is inserted into the hole by activating a boring machine feed mechanism, and wherein said device includes flexing means (13) positioned axially between the chuck means and the holder portion and a limited pivoting movement is allowed between the chuck means and the holder portion by said flexing means.

13. The method according to claim 12, wherein the holder portion is fitted on a shank adapter.

14. The method according to claim 12, wherein axial alignment between the chuck means and the holder portion is achieved elastically.

15. The method according to claim 14, wherein relative parallel displacement between the chuck means and the holder portion is allowed through a first and a second flexing portion.

16. The method according to claim 12, wherein relative parallel displacement between the chuck means and the holder portion is allowed through a first and a second flexing portion.

17. The method according to claim 16, characterized in that wherein each said flexing is allowed through an elastic pack axially between two metal members, which are connected over axially extending fasteners pressing the metal members towards each other.

18. The method according to claim 17, wherein said fasteners allow the metal members to move towards each other against the elastic resistance of the elastic pack.

19. The method according to claim 12, wherein fluid feed conduits for chuck grip fluid and bolt expansion fluid are positioned in axially extending cavities radially inside a circumference of the device.

20. The method according to claim 12, wherein the bolt and device is pushed through free inner dimensions of a drill steel support with fixed support sleeve.

* * * * *